United States Patent [19]

Suzuki

[11] 4,369,342

[45] Jan. 18, 1983

[54] MECHANISM FOR PREVENTING THE SIMULTANEOUS LOCKING FOR USE IN A PUSH BUTTON DEVICE

[75] Inventor: Yoshio Suzuki, Soma, Japan

[73] Assignee: Alps Electric Co., Ltd., Tokyo, Japan

[21] Appl. No.: 184,298

[22] Filed: Sep. 5, 1980

[30] Foreign Application Priority Data

Sep. 8, 1979 [JP] Japan ..... 54-124340[U]

[51] Int. Cl.[3] ..... H01H 9/20

[52] U.S. Cl. ..... 200/5 E; 200/50 C; 200/328

[58] Field of Search ..... 200/1 R, 5 B, 5 C, 5 E, 200/5 EA, 5 EB, 50 C, 328; 74/483 PB

[56] References Cited

U.S. PATENT DOCUMENTS

| | | | |
|---|---|---|---|
| 2,821,582 | 1/1958 | Kimball et al. | 200/5 E X |
| 3,149,208 | 9/1964 | Anderson | 200/5 E |
| 3,420,969 | 1/1969 | Edwards et al. | 200/328 X |
| 3,952,175 | 4/1976 | Golbeck et al. | 200/5 E |
| 4,143,252 | 3/1979 | Moore | 200/5 E X |
| 4,152,556 | 5/1979 | Schadow | 200/5 E X |

*Primary Examiner*—James R. Scott

*Attorney, Agent, or Firm*—Guy W. Shoup; Gerard F. Dunne

[57] ABSTRACT

A locked-type push button device has a plurality of push buttons and permits only any one of the push buttons to be locked in the depressed state when depressed. Each push button has a leaf spring for returning the push button to the initial non-depressing position, and has a cam engaging portion which can be engaged with a cam member when depressed. The cam member has a spring member to urge the cam member against the cam engaging portions. When more than two push-buttons are depressed, the total force of the two leaf springs of the two push buttons prevents the cam member from holding the cam engaging portions of two push buttons depressed.

1 Claim, 4 Drawing Figures

MECHANISM FOR PREVENTING THE SIMULTANEOUS LOCKING FOR USE IN A PUSH-BUTTON DEVICE

BACKGROUND OF THE INVENTION

The present invention relates to a push button device equipped with a plurality of push buttons, and more specifically, to a mechanism for preventing simultaneous locking of more than one pusn button in a device having a plurality of push buttons.

Electric circuits often operate erroneously when two or more push buttons of a push button device having a plurality of push buttons are inadvertently actuated at one time, particularly when the push buttons are of the type locked in their actuated condition. Consequently, such a locked-type push button device should be so constructed that all of the buttons actuated return to their initial state and do not lock whenever two or more push buttons are simultaneously actuated.

Lock-type push button devices have been proposed for use as the channel selector employed as a tuner for modern television sets since conventional channel selectors typically involved clumsy operation for selecting the channels, particularly when the channels are to be selected in the UHF band.

FIG. 1 is a diagram illustrating the appearance of a channel tuner employing push buttons for selecting various channels. After a switch 1 for selecting the appropriate band has been set to a desired band, one of the push buttons 2 for selecting the channels is actuated to select a desired channel easily. With channel tuners of this type, however, the many number of channels in the VHF, UHF, and perhaps, CATV bands require increased number of push buttons arrayed with only a small distance between them. Therefore, unless they are actuated carefully, neighboring push buttons will often be depressed simultaneously and become locked, and the desired channel would thus not often be selected properly.

With the locked-type push button device for use in channel tuners, therefore, the push buttons should not be locked but should return to the non-depressed position when two or more push buttons are simultaneously depressed to prevent erroneous operation or erroneous selection of a channel.

Conventional channel tuners employing push buttons have not typically been provided with structures preventing simultaneous locking of two push buttons. Devices for preventing the simultaneous locking of two adjacent switches used in other fields are complex in construction and their increased manufacturing costs make them prohibitive for use in channel tuners.

SUMMARY OF THE INVENTION

The object of the present invention therefore is to provide a mechanism for preventing the simultaneous locking which is based primarily upon the push button arrangement, which is, therefore simple in construction, and has an advantageous manufacturing cost, so as to be employed easily for the channel tuners.

DESCRIPTION OF THE PREFERRED EMBODIMENT

Figure 1:
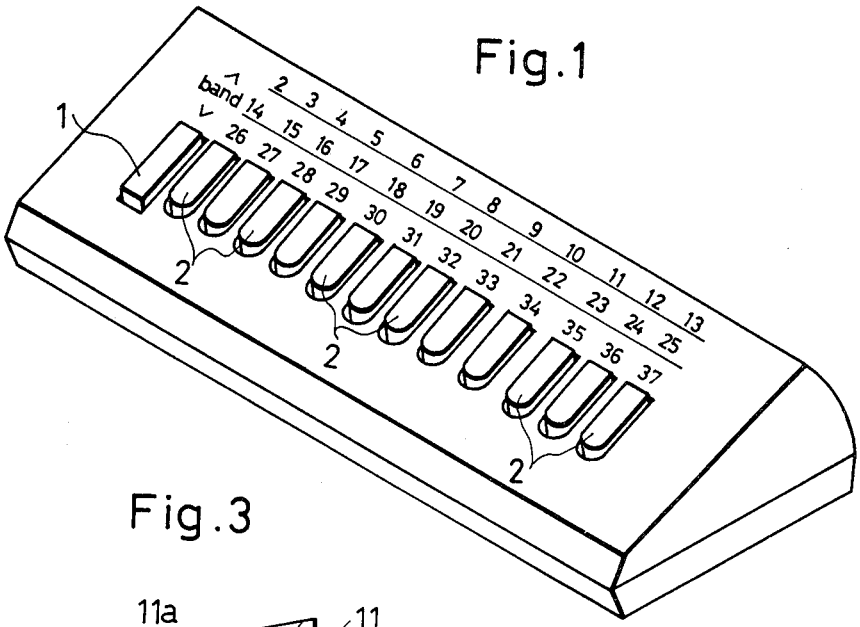
FIG. 1 is a diagram illustrating the outer features of a channel tuner embodying the present invention.
Figure 3:
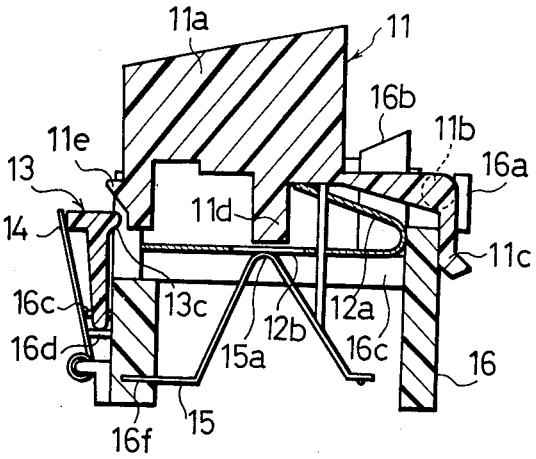
FIG. 3 is a cross-sectional view of the device of FIG. 2.

An embodiment of the invention will now be explained below in conjunction with the accompanying drawings.

Reference numeral 11 denotes a push button made of a plastic material, which consists of an operation portion 11*a*, a generally L-shaped member 11*c* extending in an inverted manner from the rear of the operation portion and having a shaft portion 11*b* which serves as a pivot for rotating the operation portion 11*a*, a contact depressing projection 11*d* extending from the bottom of the operation portion to depress a contact, as will be described below, and a cam-engaging projection 11*e* extending from the lower front portion of the operation portion and which can depress a cam plate as described below to move it out of engagement with any previously depressed push button when a push button is depressed. Reference numeral 12 denotes a leaf spring made of metal and having spring elements 12*a* formed in a V-shape, and holes 12*b* through which the contact depressing projections 11*d* of the push buttons 11 can penetrate. The spring elements 12*a* come into contact with the under side of the L-shaped member 11*c* of the push button 11 to urge the corresponding push button 11 in a direction opposite to the depressing direction. Reference numeral 13 denotes a cam plate which is commonly provided for the push buttons. Holes 13*b* for mounting the frame are formed in the lower portion of both ends, and at the center of the base plate 13*a*. On the upper portion of the base plate 13*a* are formed cam surfaces 13*c* each corresponding to a respective push button 11. The cam surfaces, however, may be formed in a continuous form.

When the push button 11 is depressed, the cam surface 13*c* is urged outwardly by the cam engaging projection 11*e* of the push button and the cam plate 13 starts to rotate. As the push button 11 is further depressed, the cam engaging projection 11*e* engages with the cam surface 13*c*. At this moment, the cam plate 13 is urged upwardly by the resilient force of coil spring 14 attached to the frame, and the push button 11 is locked or latched in the depressed state.

The coil spring 14 works to urge the cam plate 13 in direction opposite to the direction depressed by the push button 11, to maintain the engagement between the cam-engaging projection 11*e* and the cam surface 13*c*, and to hold the depressed button 11 in the depressed state. Reference numeral 15 denotes a contact having V-shaped contact portions 15*a* each corresponding to a respective push button 11. When the push button 11 is depressed, the contact depressing projection 11*d* depresses the corresponding contact portion 15*a* via the hole 12*b* in the leaf spring 12 to perform the switching operation. Reference numeral 16 denotes a frame having shaft supports 16*a* for rotatably supporting the shaft portions 11*b* of the push buttons 11, a leaf spring mounting portion consisting of plate-like projections 16*b* which engage with the notches 12*c* of the leaf spring 12 and leaf spring support portions 16*c*. A cam plate mounting portion which consists of projections 16*d* formed on the side wall of the frame and projections 16*e* that will be inserted in the holes 13*b* of the cam plate 13 is also provided and rotatably supports the cam plate 13 by these projections. A contact mounting portion 16*f* is provided for fastening the contact point 15.

The mechanism for preventing the simultaneous locking, i.e. latching of a push button, will now be explained below with reference to FIG. 4.

Figure 4:
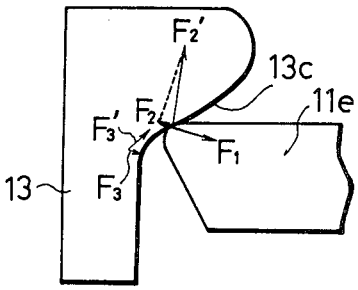
FIG. 4 is a diagram illustrating the forces which act upon a cam plate of the present invention.
Figure 2:
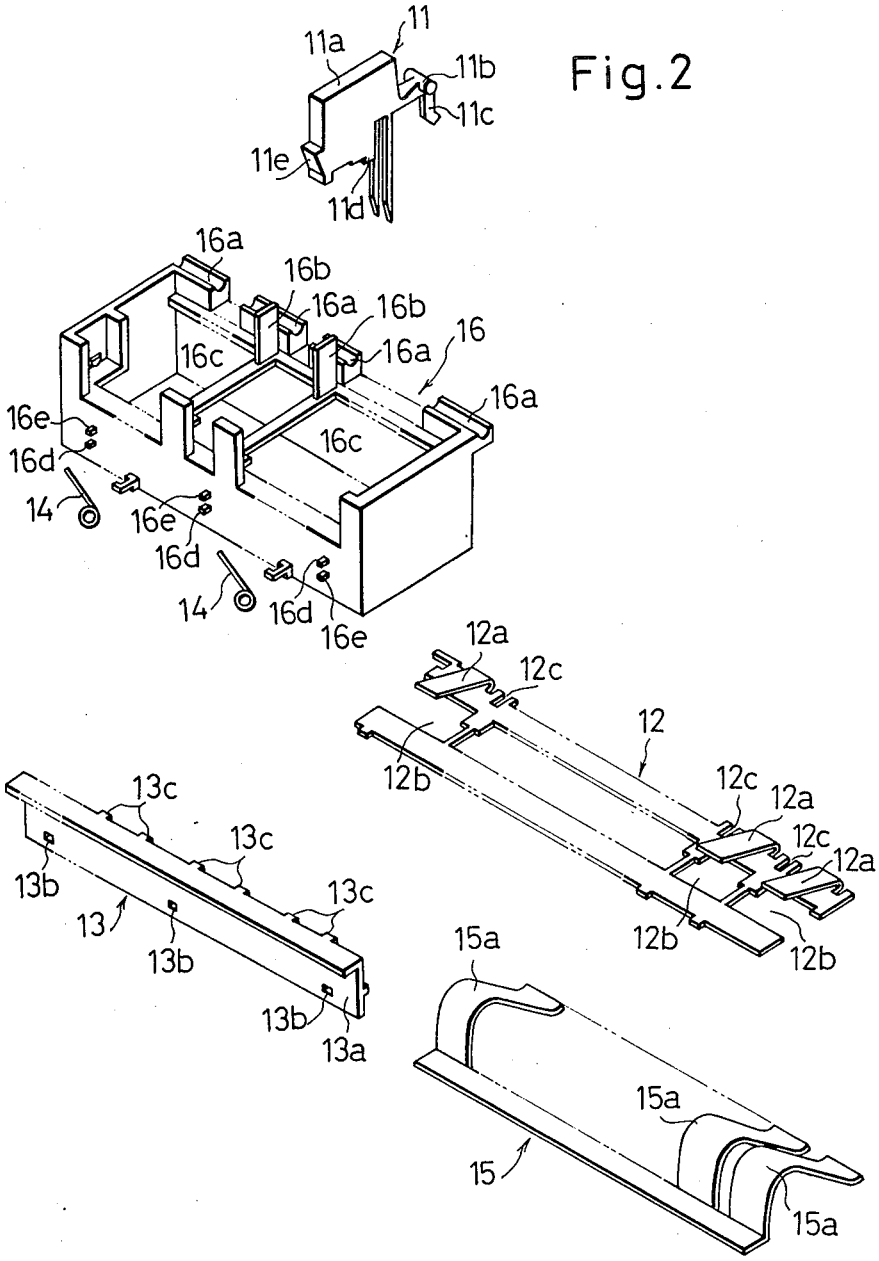
FIG. 2 is a perspective view illustrating, in a disassembled manner, a push button device employing a mechanism for preventing the simultaneous locking according to this invention.

FIG. 4 is a diagram illustrating the forces which act upon the cam plate 13. Here, the force of the coil spring 14 which urges the cam plate inwardy is denoted by $F_1$, and the force produced by the leaf spring 12 urging the push button 11 upwardly is denoted by $F_2'$. The component of the resulting forces in the direction opposite the force $F_1$, i.e., the force of the cam engaging projection 11*e* as it urges the cam plate 13 outwardly, is denoted by $F_2$, the frictional force between the cam surface 13*c* of the cam plate and the cam engaging projection 11*e* is denoted by $F_3'$, and the component in the direction of the force $F_1$ is noted by $F_3$. According to this invention, the force $F_3'$ is determined so as to satisfy the following relations (1) and (2):

$$F_2 < F_1 + F_3 \quad (1)$$

$$2F_2 > F_1 + F_3 \quad (2)$$

If the forces $F_1$ and $F_2$ remain constant, the shape of the cam surface 13*c* of the cam plate 13 is so determined that the force $F_3$ resulting from the friction will satisfy the above relations (1) and (2). Therefore, when only one push button 11 is depressed, the leaf spring 12 is not capable of expelling the cam plate 13 (relation (1)); the push button 11 is locked in the depressed state. When two or more push buttons 11 are depressed, the resilient forces of the two leaf springs expel the cam plate 13 (relation (2)); the push buttons are not held in the depressed state but are all allowed to return to the non-depressed state.

As mentioned above, this invention provides a mechanism for preventing the push buttons from being simultaneously locked, which is very simply constructed requiring reduced manufacturing cost.

What is claimed is:

1. In a switch device including a plurality of push buttons movable inwardly to a latched state, a mechanism for preventing simultaneous latching of more than one push button, including a respective cam-engaging portion extending outwardly from each said push button, means including respective spring elements for each said push button urging said push buttons to the un-latched position, a common cam member located adjacent said push buttons and having a plurality of cam surfaces lying oppositely respective cam-engaging portions, means including at least one spring member urging said cam surfaces towards engagement with said cam-engaging portions to apply a force whereby inward movement of any push button towards its latched position can slide the cam-engaging portion associated therewith against the respective cam surface to move the cam member out of engagement with any previously latched push button and, after the cam-engaging portion has moved past the respective cam surface, urge said cam surface against the cam-engaging portion of the actuated push button with sufficient frictional resistance therebetween to hold the actuated push button in its latched position, said force being insufficient to hold two of said push buttons in their latched position against the resilient forces applied by the spring elements thereof.

* * * * *